US008851351B2

(12) United States Patent
Yeh

(10) Patent No.: US 8,851,351 B2
(45) Date of Patent: Oct. 7, 2014

(54) TRIGGER ASSEMBLY FOR SWITCHING ONE SHOOT MODE OR REPEAT SHOOT MODE

(75) Inventor: Tung-Sung Yeh, Taichung (TW)

(73) Assignee: Apach Industrial Co., Ltd., Taichung (TW)

( * ) Notice: Subject to any disclaimer, the term of this patent is extended or adjusted under 35 U.S.C. 154(b) by 600 days.

(21) Appl. No.: 13/228,464

(22) Filed: Sep. 9, 2011

(65) Prior Publication Data

US 2013/0062390 A1 Mar. 14, 2013

(51) Int. Cl.
*B25C 1/00* (2006.01)
*B25C 1/04* (2006.01)

(52) U.S. Cl.
CPC ..... *B25C 1/047* (2013.01); *B25C 1/008* (2013.01); *B25C 1/046* (2013.01)
USPC ..... 227/8; 173/170

(58) Field of Classification Search
CPC ..... B25C 1/008; B25C 1/04; B25C 1/043; B25C 1/047
USPC ..... 227/8, 10, 35, 129, 130, 156; 173/170, 173/171
See application file for complete search history.

(56) References Cited

U.S. PATENT DOCUMENTS 5,687,897 A * 11/1997 Fa et al. ..... 227/8
5,836,501 A * 11/1998 Lai ..... 227/8
5,862,969 A * 1/1999 Lee ..... 227/8
6,213,372 B1 * 4/2001 Chen ..... 227/8
6,581,814 B1 * 6/2003 Hsu ..... 227/8
6,588,642 B1 * 7/2003 Wang et al. ..... 227/8
6,659,324 B1 * 12/2003 Liu ..... 227/8
6,860,416 B1 * 3/2005 Chen ..... 227/8
6,886,729 B1 * 5/2005 Lee ..... 227/8
6,929,165 B1 * 8/2005 Chen et al. ..... 227/8
6,948,646 B2 * 9/2005 Huang ..... 227/8
7,083,074 B2 * 8/2006 Chen ..... 227/123
7,143,918 B2 * 12/2006 Aguirre et al. ..... 227/8
7,152,773 B2 * 12/2006 Ke ..... 227/8
7,191,927 B2 * 3/2007 Segura ..... 227/8
7,213,733 B1 * 5/2007 Wen et al. ..... 227/8
7,255,326 B2 * 8/2007 Wang ..... 251/234
7,308,995 B2 * 12/2007 Uchiyama et al. ..... 227/8
7,314,154 B2 * 1/2008 Huang et al. ..... 227/8
7,322,426 B2 * 1/2008 Aguirre et al. ..... 173/1
7,464,843 B2 * 12/2008 Huang ..... 227/8
7,475,800 B2 * 1/2009 Liang ..... 227/130
7,530,482 B1 * 5/2009 Ho ..... 227/8
7,810,688 B2 * 10/2010 Wu et al. ..... 227/8
7,971,766 B2 * 7/2011 Tang ..... 227/8
7,975,890 B2 * 7/2011 Tang ..... 227/8
8,109,425 B2 * 2/2012 Liu et al. ..... 227/8

(Continued)

*Primary Examiner* — Thanh Truong
*Assistant Examiner* — Eduardo R Ferrero

(57) ABSTRACT

A trigger assembly for switching one shoot mode or repeat shoot mode includes a trigger, a switch, a fixing element, a trigger plate and a torsion spring. When a user wants to switch the shoot modes of the nail gun, the user turns the switch so that the fixing element moves along the curved track of the switch and the fixing element drives the trigger plate to move on a protrusion or on a through hole simultaneously. After the user presses the trigger, the trigger plate is resisted by the protrusion so that the nail gun is in one shoot mode. In addition, when the trigger plate is vibrating on the through hole, the nail gun is in repeat shoot mode.

8 Claims, 9 Drawing Sheets

(56) References Cited

U.S. PATENT DOCUMENTS

| | | | | |
|---|---|---|---|---|
| 2005/0023318 | A1* | 2/2005 | Aguirre et al. | 227/8 |
| 2005/0067453 | A1* | 3/2005 | Huang | 227/8 |
| 2006/0213945 | A1* | 9/2006 | Ke | 227/8 |
| 2006/0255085 | A1* | 11/2006 | Wen | 227/8 |
| 2006/0255086 | A1* | 11/2006 | Aguirre et al. | 227/8 |
| 2006/0261121 | A1* | 11/2006 | Uchiyama et al. | 227/8 |
| 2007/0075113 | A1* | 4/2007 | Tillinghast et al. | 227/130 |
| 2008/0185415 | A1* | 8/2008 | Huang | 227/8 |
| 2008/0264996 | A1* | 10/2008 | Chang | 227/8 |
| 2008/0272169 | A1* | 11/2008 | Liang | 227/130 |
| 2008/0290131 | A1* | 11/2008 | Liang et al. | 227/130 |
| 2009/0108046 | A1* | 4/2009 | Huang | 227/8 |
| 2009/0159633 | A1* | 6/2009 | Wu | 227/8 |
| 2010/0051667 | A1* | 3/2010 | Tang | 227/130 |
| 2010/0301091 | A1* | 12/2010 | Liang et al. | 227/8 |
| 2011/0248061 | A1* | 10/2011 | Liu et al. | 227/8 |
| 2012/0298712 | A1* | 11/2012 | Ishizawa et al. | 227/8 |
| 2013/0014608 | A1* | 1/2013 | Yang | 74/522 |
| 2013/0062390 | A1* | 3/2013 | Yeh | 227/8 |

* cited by examiner

TRIGGER ASSEMBLY FOR SWITCHING ONE SHOOT MODE OR REPEAT SHOOT MODE

BACKGROUND OF THE INVENTION

1. Field of the Invention

The present invention relates to a trigger assembly, more particularly to a trigger assembly for switching one shoot mode or repeat shoot mode.

2. Description of Related Art

The conventional trigger assembly is usually attached to a nail gun so that the nail gun has one shoot mode and repeat shoot mode for a user to operate. One shoot mode is only one triggering with one shoot. Repeat mode is holding trigger with several shoots. Thus, the user can choose one suitable mode in order to deal with their tasks conveniently.

The conventional trigger assembly is often set up nearby the trigger of the nail gun for switching two shoot modes. However, the conventional trigger assembly is often operated incoherently with the trigger of the nail gun so that the user is often one triggering with several shoots. In order to improve this shortcoming, the conventional trigger assembly is designed with many complicated elements. Consequently, the response time for switching two modes becomes longer. One shortcoming is solved and another shortcoming is raised.

The present invention has arisen to mitigate and/or obviate the disadvantages of the conventional.

SUMMARY OF THE INVENTION

The main objective of the present invention is to provide an improved trigger assembly for switching one shoot mode or repeat shoot mode.

To achieve the objective, a trigger assembly for switching one shoot mode or repeat shoot mode comprises a trigger, a receiving room defined in the trigger, a through hole defined at one end of the bottom of the receiving room, a protrusion extruded from a wall of the receiving room and facing to the through hole, the size of the protrusion smaller than the through hole, a switch pivoted on one end of the receiving room and opposite to the location of the through hole, a curved track defined radially on the switch, a fixing element, an actuator formed at one end of the fixing element and placed into the curved track, a trigger plate, one end of the trigger plate abutted against the fixing element and a pivotal cylinder passing therethrough for pivoting trigger plate on the fixing element, another end of the trigger plate extending to the through hole of the trigger and above the through hole, a torsion spring pivoted on the pivotal cylinder, one end of the torsion spring resisted against the trigger plate and another end resisted against the receiving room; wherein when a user turns the switch, the actuator of the fixing element moving along the curved track and the fixing element driving the trigger plate to move axially above the protrusion or the through hole; the nail gun is under one shoot mode when the user presses the trigger and the trigger plate is resisted against by the protrusion; the nail gun is under repeat shoot mode when the user presses the trigger and the trigger plate is swinging in the through hole.

A limiting block is extruded up from the bottom of the receiving room and one end of the torsion spring is fastened by the limiting block.

A switching groove is defined laterally at the receiving room for positioning the switch, a positioning column disposed in the switch groove, a sliding groove defined radially on the switch and corresponding to the positioning column, two dimples defined at two sides of the sliding groove respectively for positioning; thereby when the user rotates the switch, the positioning column is escaped from one dimple and moves to engage with another dimple via sliding groove in the trigger, such that the shoot mode is locked at one shoot mode or repeat shoot mode.

A first groove is defined axially on the switch and communicated with one end of the curved track, a supporter formed on the fixing element and corresponding to the first groove, the supporter vertically connected to one end of the actuator and received into the first groove; thereby the fixing element is pivoted to the switch.

A tuner is formed on one end of the switch for the user to turn the switch, another end of the switch connected to a fastener for pivoting on the receiving room stably, two ends of the switch exposed out of the receiving room of the trigger.

At least one first pivotal ring is formed at another end of the fixing element, at least one second pivotal ring formed on the trigger plate and corresponding to the first pivotal rings, the pivotal cylinder passing through the first pivotal rings and the second pivotal rings for pivoting the trigger plate on the fixing element in the receiving room, two ends of the pivotal cylinder being located at two side walls of the receiving room respectively.

The torsion spring is pivoted on the pivotal cylinder and near the second pivotal rings.

An indentation is defined on the trigger plate and corresponding to the location of the protrusion.

A bending portion is located between the second pivotal ring and the indentation on the trigger plate, one end of the torsion spring resisted against the bending portion of the trigger plate for recovering the position of the trigger plate.

Further benefits and advantages of the present invention will become apparent after a careful reading of the detailed description with appropriate reference to the accompanying drawings.

DETAILED DESCRIPTION OF THE INVENTION

Figure 1:
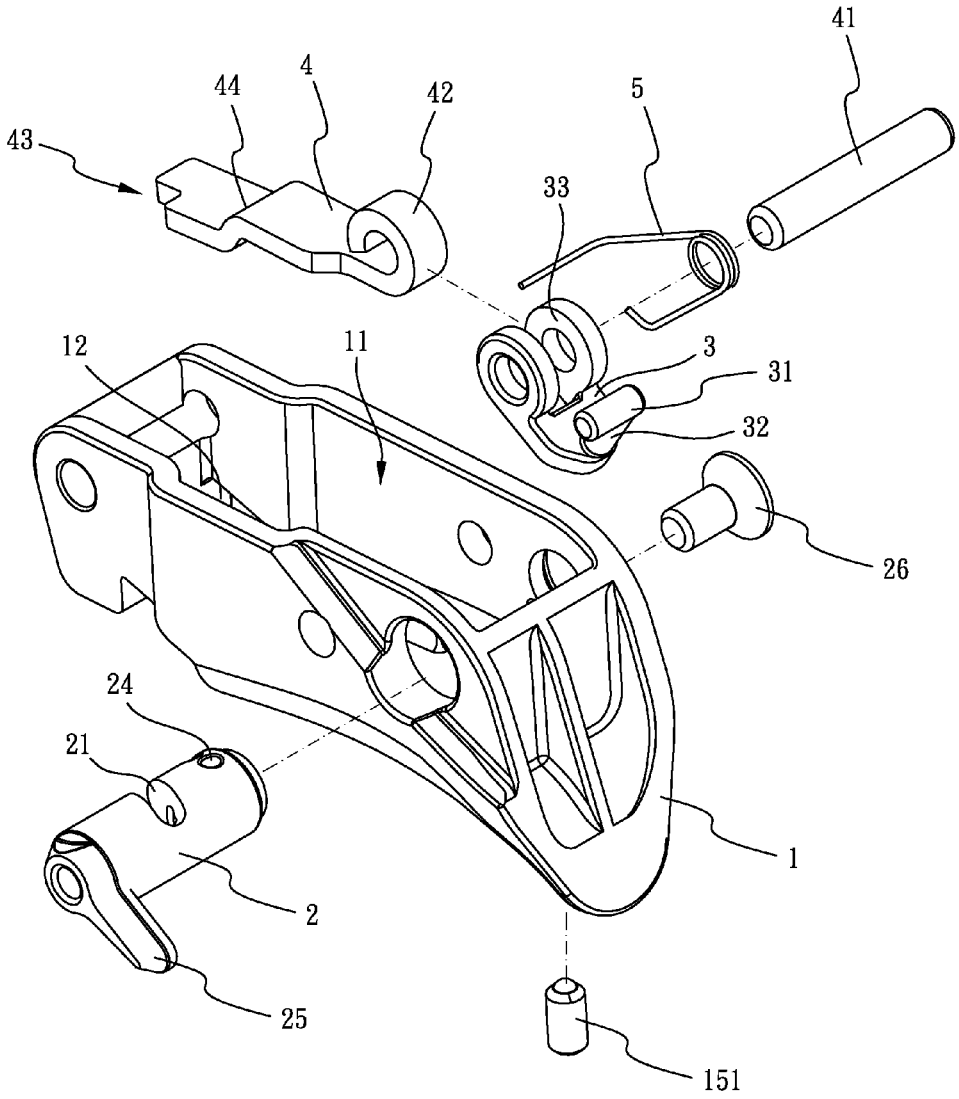
FIG. 1 is an exploded view of a trigger assembly for switching one shoot mode or repeat shoot mode in accordance with the present invention.
Figure 3:
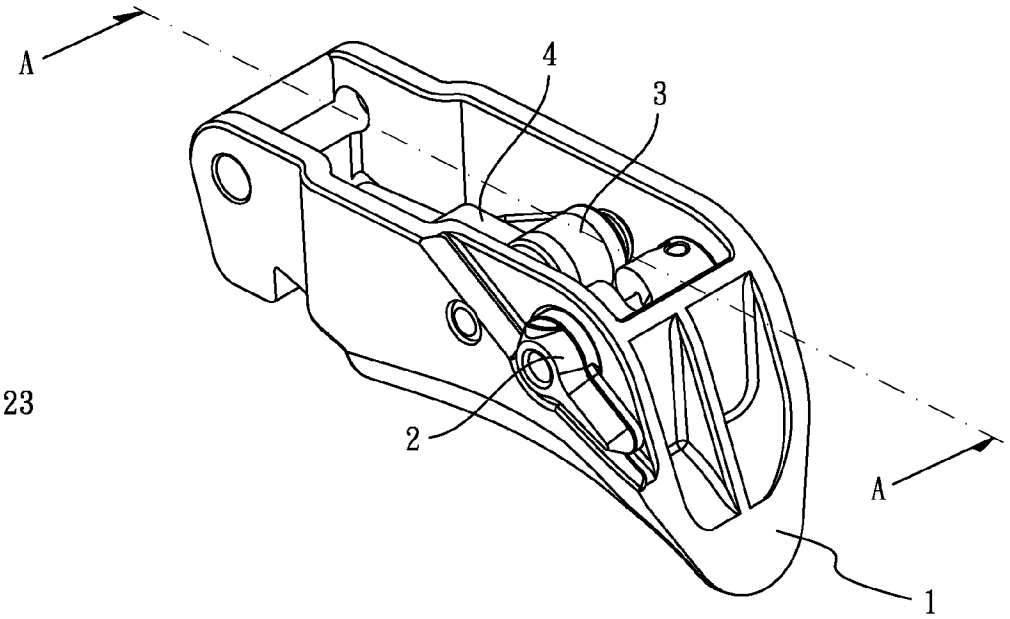
FIG. 3 is an assembled view of the trigger assembly for switching one shoot mode or repeat shoot mode in accordance with the present invention.
Figure 2:
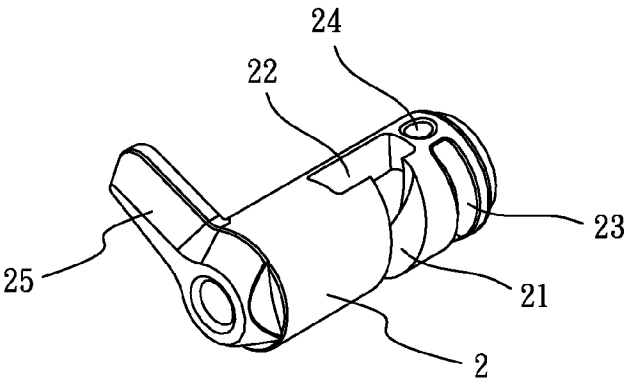
FIG. 2 is a perspective view of a switch in accordance with the present invention.
Figure 4:
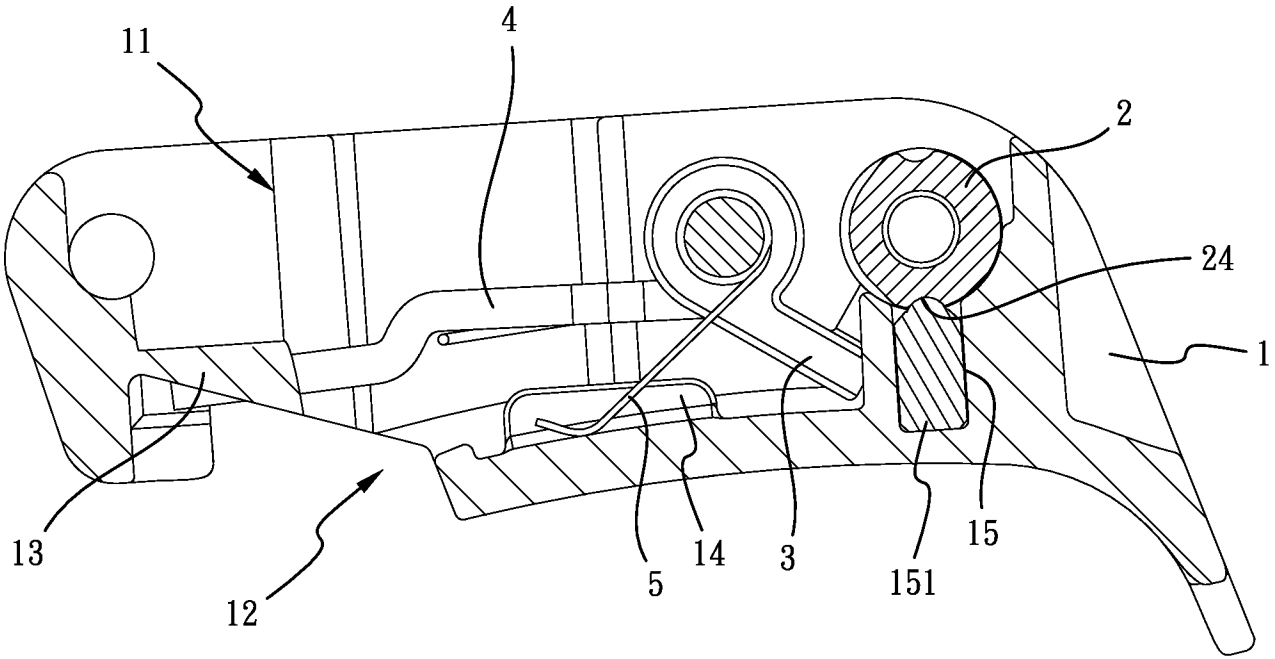
FIG. 4 is a cross-sectional view of the trigger assembly for switching one shoot mode or repeat shoot mode along a line AA in the FIG. 3.
Figure 5:
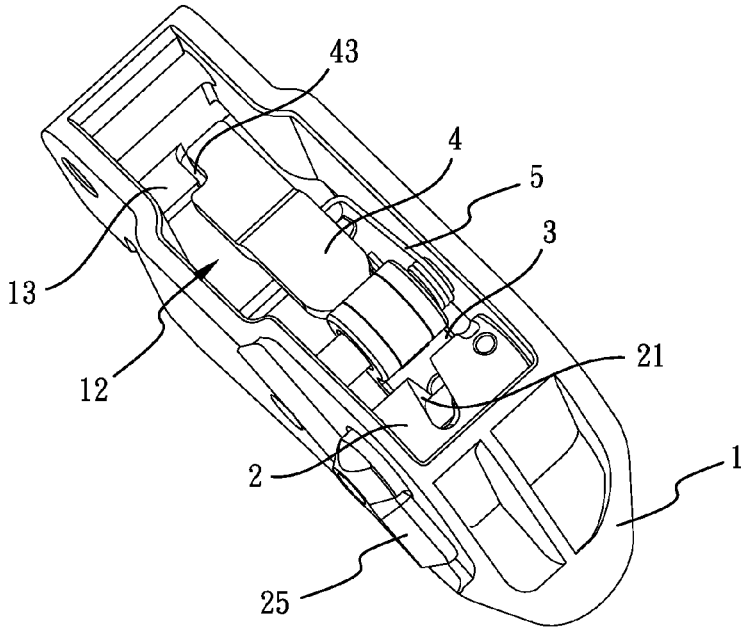
FIG. 5 is a perspective view for showing the trigger assembly under repeat shoot mode.
Figure 6:
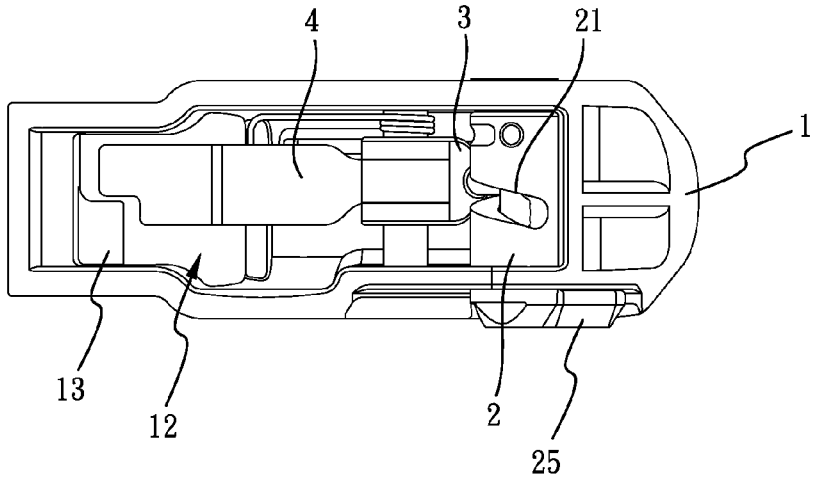
FIG. 6 is a top view for showing the trigger assembly under repeat shoot mode.
Figure 7:
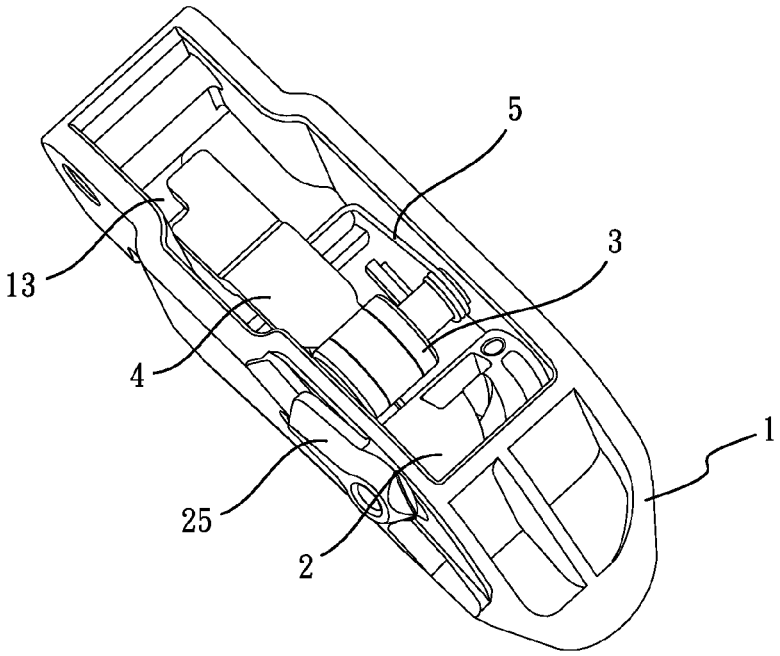
FIG. 7 is a perspective view for showing the trigger assembly under one shoot mode.
Figure 8:
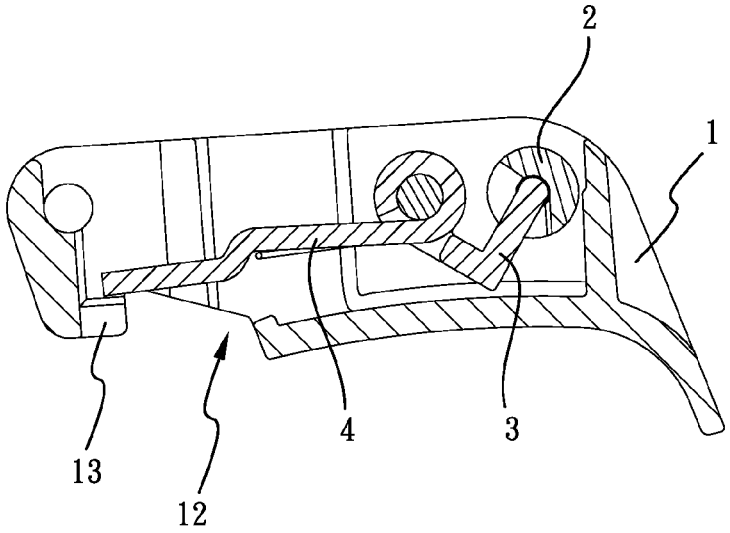
FIG. 8 is a top view for showing the trigger assembly under one shoot mode.

Referring to the drawings to FIGS. 1-4, a trigger assembly for switching one shoot mode or repeat shoot mode in accordance with the present invention comprises a trigger 1, a switch 2, a fixing element 3, a trigger plate 4 and a torsion spring 5.

Figure 9:
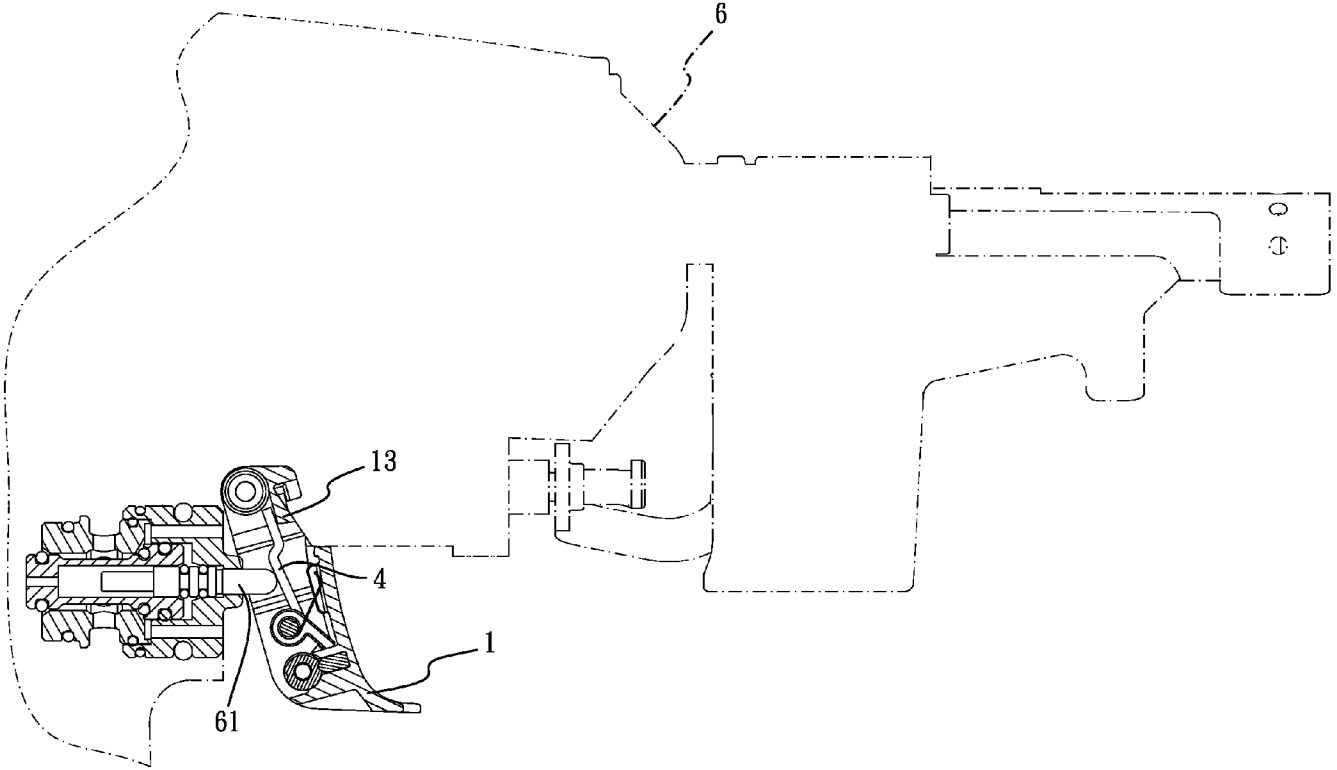
FIG. 9 is a partial cross-sectional view for showing the trigger assembly being in one shoot mode and assembled on a nail gun at an initial state.

One end of the trigger 1 is pivoted on a nail gun 6 (as shown in FIG. 9). Another end of the trigger 1 is a free end for a user to trigger. A receiving room 11 is defined in the trigger 1. A through hole 12 is defined at one end of the bottom of the receiving room 11. A protrusion 13 is extruded from a wall of the receiving room 11 and is facing to the through hole 12. The size of the protrusion 13 is smaller than the through hole 12. A limiting block 14 is extruded up from the bottom of the receiving room 11. A switching groove 15 is defined laterally at the receiving room 11 for positioning the switch 2. A positioning column 151 is disposed in the switch groove 15.

The switch 2 is pivoted on another end of the receiving room 11 which is opposite to the location of the through hole 12. One end of the switch 2 is connected to a fastener 26 for pivoting on the receiving room 11 stably. A curved track 21 is defined radially on the switch 2. A first groove 22 is defined axially on the switch 2 and communicated with one end of the curved track 21. A sliding groove 23 is defined radially on the switch 2 and close to the fastener 26. The sliding groove 23 is corresponding to the positioning column 151. Two dimples 24 are defined at two sides of the sliding groove 23 respectively for positioning A tuner 25 is formed on another end of the switch 2 for the user to switch. Two ends of the switch 2 are exposed out of the receiving room 11 of the trigger 1. When the user turns the tuner 25, the switch 2 is rotating to switch shoot modes.

An actuator 31 is formed at one end of the fixing element 3 and is placed into the curved track 21. A supporter 32 is formed on the fixing element 3 and corresponding to the first groove 22. The supporter 32 is vertically connected to one end of the actuator 31. The supporter 32 is received into the first groove 22, thereby the fixing element 3 is pivoted to the switch 2. At least one first pivotal ring 33 is formed at another end of the fixing element 3 (Here are two first pivotal rings 33 in the embodiment).

One end of the trigger plate 4 is abutted against the first pivotal rings 33 of the fixing element 3 and a pivotal cylinder 41 passes therethrough for pivoting trigger plate 4 on the fixing element 3. Another end of the trigger plate 4 is extending to the through hole 12 of the trigger 1 and above the through hole 12. The trigger plate 4 is resisted against by an air powered actuator 61 (as shown in FIGS. 9-13). At least one second pivotal ring 42 is formed on the trigger plate 4 and corresponding to the first pivotal rings 33. The pivotal cylinder 41 passes through the first pivotal rings 33 and the second pivotal rings 42 for pivoting the trigger plate 4 on the fixing element 3 in the receiving room 11. Two ends of the pivotal cylinder 41 locate at two side walls of the receiving room 11 respectively. An indentation 43 is defined on the trigger plate 4 and corresponding to the location of the protrusion 13. A bending portion 44 is located between the second pivotal ring 42 and the indentation 43 on the trigger plate 4.

The torsion spring 5 is pivoted on the pivotal cylinder 41 and near the second pivotal rings 42. One end of the torsion spring 5 is resisted against the bottom of the receiving room 11 and fastened by the limiting block 14, and another end is resisted against the bending portion 44 of the trigger plate 4 for recovering the position of the trigger plate 4.

Figure 10:
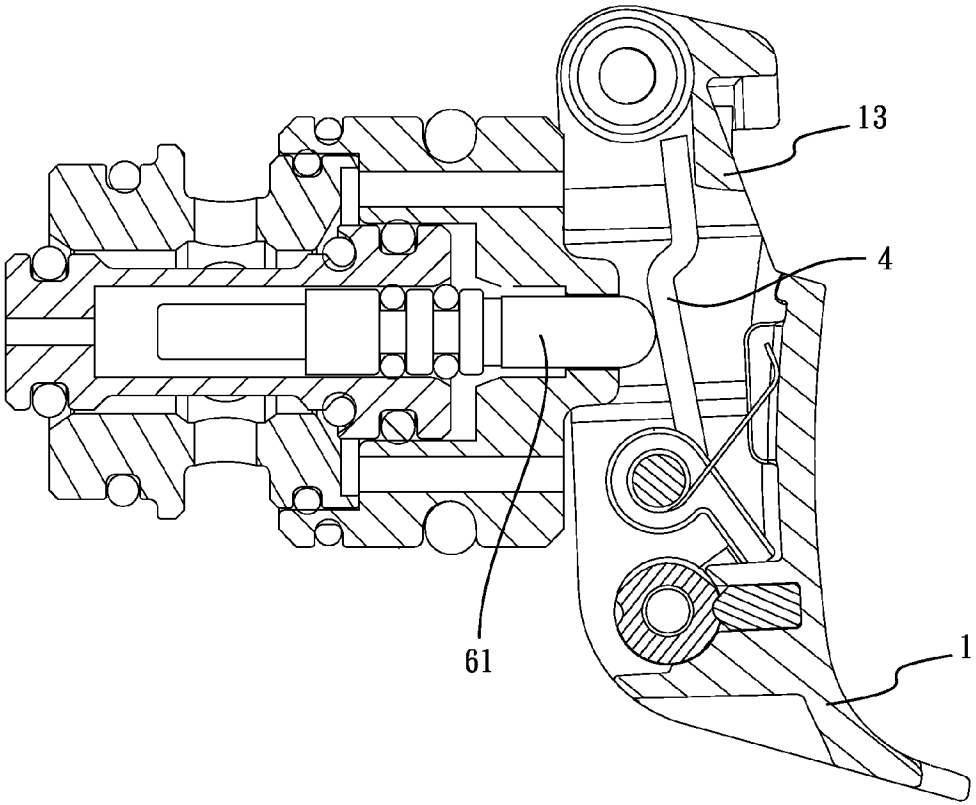
FIG. 10 is a partial cross-sectional view for showing the trigger assembly being in one shoot mode when an air powered actuator is pressed.
Figure 11:
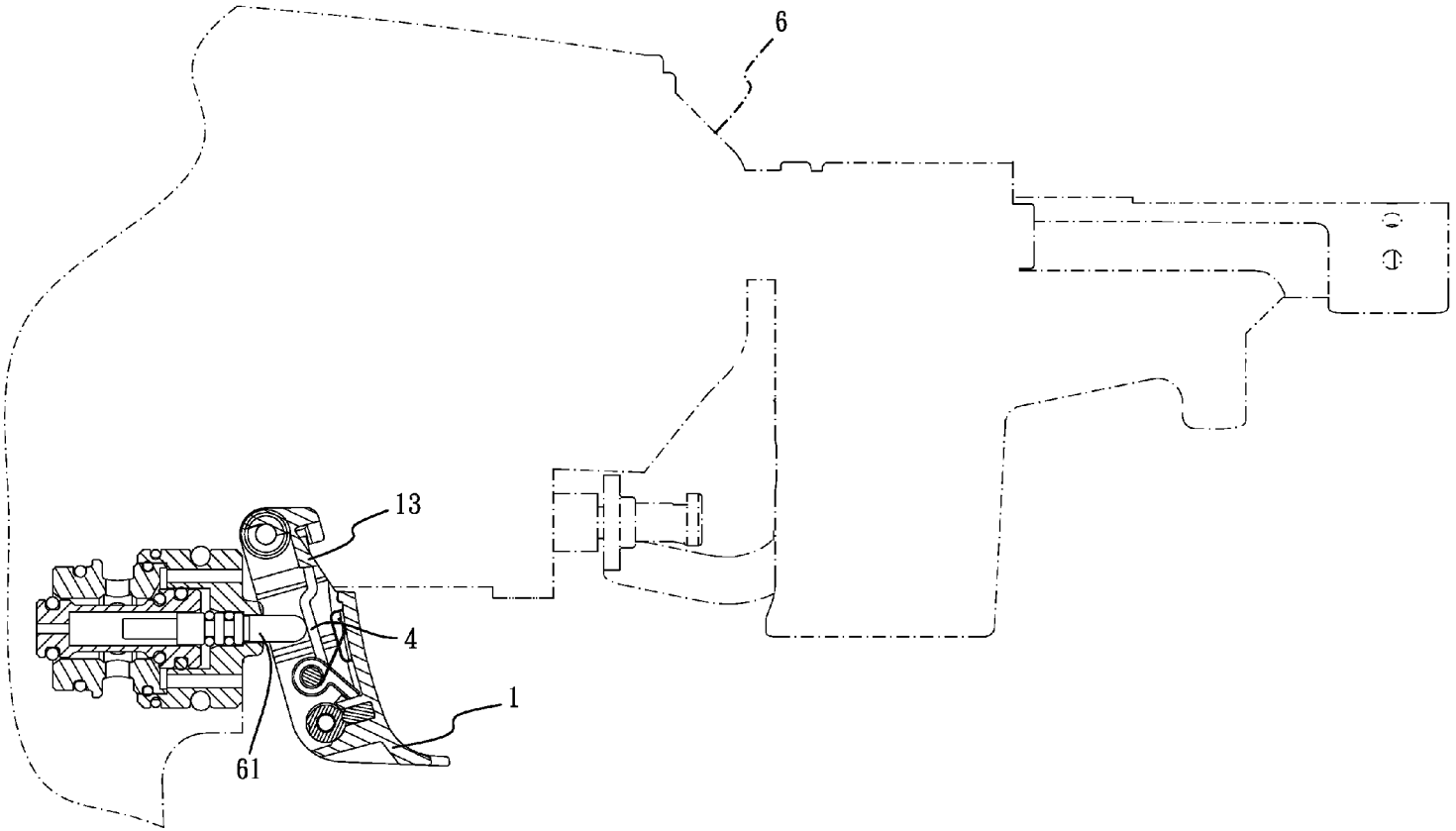
FIG. 11 is a partial cross-sectional view for showing the trigger assembly being in repeat shoot mode and assembled on the nail gun at an initial state.
Figure 13:
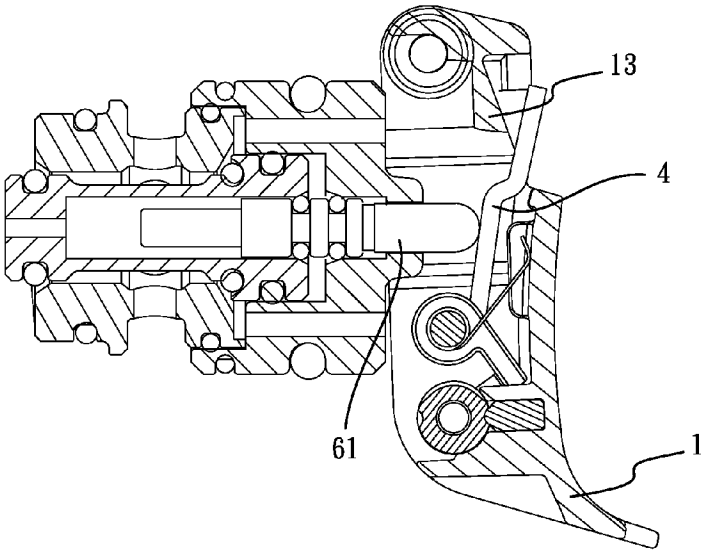
FIG. 13 is a partial cross-sectional view for showing the trigger assembly being in repeat shoot mode when the air powered actuator is back to its initial state and a trigger plate is swinging out of a through hole.
Figure 12:
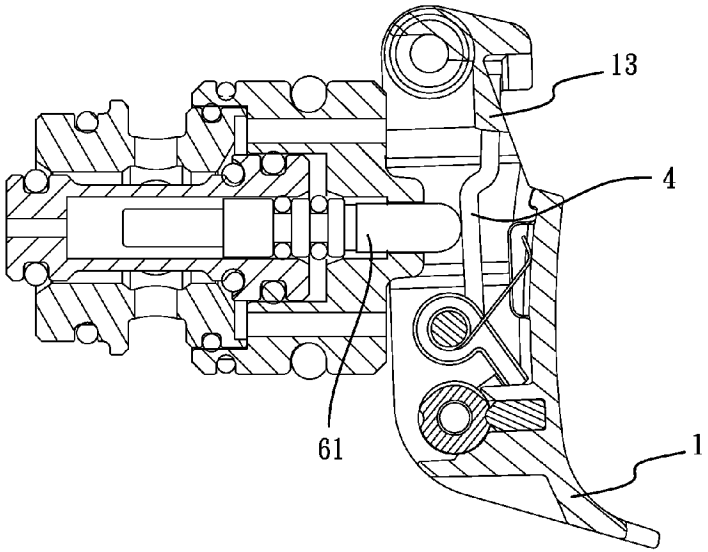
FIG. 12 is a partial cross-sectional view for showing the trigger assembly being in repeat shoot mode when the air powered actuator is pressed.

Referring to FIGS. 4-8, when the user tries to switch the shoot modes of the nail gun, the user turns the tuner 25 so that the switch 2 is rotated. Simultaneously, the actuator 31 of the fixing element 3 moves along the curved track 21 and the fixing element 3 drives the trigger plate 4 to move axially above the protrusion 13 or the through hole 12. (The indentation 43 of the trigger plate 4 can prevent the protrusion 13 resisting against the trigger plate 4 when the trigger plate 4 is moving to the through hole 12.) When the user presses the trigger 1 and the trigger plate 4 is resisted against by the protrusion 13, the nail gun 6 is under one shoot mode. (As shown in FIGS. 9-10, one end of the trigger plate 4 is pivoted on the fixing element 3 and another end is resisted against by the protrusion 13. Consequently, when the user presses the trigger 1, the trigger plate 4 is kept abutting against the air powered actuator 61 and the air powered actuator 61 cannot recover to the initial position, and the result is one shoot mode.) When the user presses the trigger 1 and the trigger plate 4 is swinging in the through hole 12, the nail gun 6 is under repeat shoot mode. (As shown in FIGS. 11-13, one end of the trigger plate 4 is pivoted on the fixing element 3 and another end is not resisted against by the protrusion 13. Consequently, after the user presses the trigger 1, the air powered actuator 61 can recover to the initial position and push the trigger plate 4 to the through hole 12, and the result is repeat shoot mode for the user to keep doing the task.) Furthermore, when the user rotates the switch 2, the positioning column 151 is escaped from one dimple 24 and moves to engage with another dimple 24 via sliding groove 23 in the trigger 1. Therefore, the positioning column 151 engaged with different dimples 24 can lock the shoot mode under one shoot mode or repeat shoot mode.

The most important difference from the prior art is the switch mechanism designed in the trigger 1 directly. Therefore, there are no other additional assemblies needed to attach to the nail gun 6. Only the trigger 1 is set up on the nail gun 6. In addition, the one shoot mode or the repeat shoot mode can be locked by the engagement between the positioning column 151 and the dimples 24 of the switch 2. Therefore, one triggering with several shoots never happens in the present invention.

Although the invention has been explained in relation to its preferred embodiment, it is to be understood that many other possible modifications and variations can be made without departing from the spirit and scope of the invention as hereinafter claimed.

What is claimed is:

1. A trigger assembly for switching one shoot mode or repeat shoot mode comprising:

a trigger, a receiving room defined in the trigger, a through hole defined at one end of the bottom of the receiving room, a protrusion extruded from a wall of the receiving room and facing to the through hole, the size of the protrusion smaller than the through hole;

a switch pivoted on one end of the receiving room and opposite to the location of the through hole, a curved track defined radially on the switch;

a fixing element, an actuator formed at one end of the fixing element and placed into the curved track;

a trigger plate, one end of the trigger plate abutted against the fixing element and a pivotal cylinder passing therethrough for pivoting trigger plate on the fixing element, another end of the trigger plate extending to the through hole of the trigger and above the through hole; and a torsion spring pivoted on the pivotal cylinder, one end of the torsion spring resisted against the trigger plate and another end resisted against the receiving room;

wherein when a user turns the switch, the actuator of the fixing element moving along the curved track and the fixing element driving the trigger plate to move axially above the protrusion or the through hole; the nail gun is under one shoot mode when the user presses the trigger and the trigger plate is resisted against by the protrusion; the nail gun is under repeat shoot mode when the user presses the trigger and the trigger plate is swinging in the through hole; and wherein at least one first pivotal ring is formed at another end of the fixing element, at least one second pivotal ring formed on the trigger plate and corresponding to the first pivotal rings, the pivotal cylinder passing through the first pivotal rings and the second pivotal rings for pivoting the trigger plate on the fixing element in the receiving room, two ends of the pivotal cylinder being located at two side walls of the receiving room respectively.

2. The trigger assembly for switching one shoot mode or repeat shoot mode as claimed in claim 1, wherein a limiting block is extruded up from the bottom of the receiving room and one end of the torsion spring is fastened by the limiting block.

3. The trigger assembly for switching one shoot mode or repeat shoot mode as claimed in claim 1, wherein a switching groove is defined laterally at the receiving room for positioning the switch, a positioning column disposed in the switch groove, a sliding groove defined radially on the switch and corresponding to the positioning column, two dimples defined at two sides of the sliding groove respectively for positioning; thereby when the user rotates the switch, the positioning column is escaped from one dimple and moves to engage with another dimple via sliding groove in the trigger, such that the shoot mode is locked at one shoot mode or repeat shoot mode.

4. The trigger assembly for switching one shoot mode or repeat shoot mode as claimed in claim 1, wherein a first groove is defined axially on the switch and communicated with one end of the curved track, a supporter formed on the fixing element and corresponding to the first groove, the supporter vertically connected to one end of the actuator and received into the first groove; thereby the fixing element is pivoted to the switch.

5. The trigger assembly for switching one shoot mode or repeat shoot mode as claimed in claim 1, wherein a tuner is formed on one end of the switch for the user to turn the switch, another end of the switch connected to a fastener for pivoting on the receiving room stably, two ends of the switch exposed out of the receiving room of the trigger.

6. The trigger assembly for switching one shoot mode or repeat shoot mode as claimed in claim 1, wherein the torsion spring is pivoted on the pivotal cylinder and near the second pivotal rings.

7. A trigger assembly for switching one shoot mode or repeat shoot mode, comprising:

a trigger, a receiving room defined in the trigger, a through hole defined at one end of the bottom of the receiving room, a protrusion extruded from a wall of the receiving room and facing to the through hole, the size of the protrusion smaller than the through hole;

a switch pivoted on one end of the receiving room and opposite to the location of the through hole, a curved track defined radially on the switch;

a fixing element, an actuator formed at one end of the fixing element and placed into the curved track;

a trigger plate, one end of the trigger plate abutted against the fixing element and a pivotal cylinder passing therethrough for pivoting trigger plate on the fixing element, another end of the trigger plate extending to the through hole of the trigger and above the through hole, wherein an indentation is defined on the trigger plate and corresponding to the location of the protrusion; and a torsion spring pivoted on the pivotal cylinder, one end of the torsion spring resisted against the trigger plate and another end resisted against the receiving room;

wherein when a user turns the switch, the actuator of the fixing element moving along the curved track and the fixing element driving the trigger plate to move axially above the protrusion or the through hole; the nail gun is under one shoot mode when the user presses the trigger and the trigger plate is resisted against by the protrusion; the nail gun is under repeat shoot mode when the user presses the trigger and the trigger plate is swinging in the through hole.

8. The trigger assembly for switching one shoot mode or repeat shoot mode as claimed in claim 7, wherein a bending portion is located between the second pivotal ring and the indentation on the trigger plate, one end of the torsion spring resisted against the bending portion of the trigger plate for recovering the position of the trigger plate.

* * * * *